US005375768A

United States Patent [19]

Clark

[11] Patent Number: 5,375,768

[45] Date of Patent: Dec. 27, 1994

[54] MULTIPLE RANGE VARIABLE SPEED TURBINE

[75] Inventor: Michael L. Clark, San Marcos, Calif.

[73] Assignee: Hunter Industries, San Marcos, Calif.

[21] Appl. No.: 130,008

[22] Filed: Sep. 30, 1993

[51] Int. Cl.[5] ..... B05B 3/04

[52] U.S. Cl. ..... 239/210; 239/205; 239/206; 239/240; 239/263; 239/570

[58] Field of Search ..... 239/203, 204, 205, 206, 239/237, 240, 263, 464, 570, 210

[56] References Cited

U.S. PATENT DOCUMENTS

| | | | |
|---|---|---|---|
| 4,026,471 | 5/1977 | Hunter | 239/206 |
| 4,417,691 | 11/1983 | Lockwood | 239/206 |
| 4,681,260 | 7/1987 | Cochran | 239/240 |
| 4,773,595 | 9/1988 | Livne | 239/242 |
| 4,867,379 | 9/1989 | Hunter | 239/240 |
| 4,892,252 | 1/1990 | Bruninga | 239/206 X |

*Primary Examiner*—William Grant

*Attorney, Agent, or Firm*—Baker, Maxham, Jester & Meador

[57] ABSTRACT

A sprinkler unit for distributing water from a source over an area of terrain comprises a tubular housing having an inlet connected by a passage to an outlet, a distributor head mounted at the outlet for rotation about an axis for distribution of water via a nozzle, a turbine wheel disposed in the housing passage and operatively connected for driving the distributor head, and a turbine stator assembly having a passage including a throttling device for controllably directing a first portion of water to the turbine wheel, and a pressure responsive valve for controllably diverting a second portion of the water around the turbine wheel in proportion to the pressure thereof for maintaining the speed of the turbine substantially constant.

17 Claims, 2 Drawing Sheets

MULTIPLE RANGE VARIABLE SPEED TURBINE

BACKGROUND OF THE INVENTION

The present invention relates to sprinkler units and pertains particularly to a turbine driven sprinkler unit having improved range speed control of the turbine for uniform water distribution.

The artificial distribution of water through irrigation systems is in wide use throughout the world today. There are many irrigation systems utilized, with each having its own benefits and drawbacks.

One of the most widely used systems, particularly where water is not abundant or plentiful, is the sprinkler system wherein a plurality of nozzles are distributed about an area for distributing water over the surface of the land area. Such systems are widely used for lawns, golf courses, playing fields and many field crops.

The ideal sprinkler irrigation system would utilize a minimum number of nozzles to achieve a substantially uniform distribution of water over a maximum area. One of the problems with present sprinkler units used in such systems is that the water pressure to the sprinklers may vary from time to time as well as between sprinkler units. This is particularly troublesome where the sprinkler unit is rotated or oscillated by means of a turbine driven by the water supply. The typical turbine will vary in speed with variation in water flow, which varies with pressure.

Accordingly, it is desirable that a turbine driven sprinkler unit be available having means for providing substantially uniform rate of rotation for variable ranges of pressure and flow.

SUMMARY AND OBJECTS OF THE INVENTION

Accordingly, it is a primary object of the present invention to provide a turbine driven sprinkler unit having means for providing substantially uniform rate of rotation for variable ranges of pressure and flows.

In accordance with the primary aspect of the present invention, a sprinkler unit for distributing water from a source over an area of terrain comprises a tubular housing having an inlet connected by a passage to an outlet, a distributor head mounted on said housing at said outlet for rotation about an axis for distribution of water via a nozzle, a turbine wheel disposed in said housing passage and operatively connected for driving said distributor head, and a turbine stator assembly having first means including throttling means for controllably directing a first portion of water to said turbine wheel, and second means including pressure responsive valve means for controllably diverting a second portion of the water around said turbine in proportion to the pressure thereof for maintaining the speed of the turbine substantially constant.

In accordance with another aspect, the throttling means is removable for providing a second range of speed for the turbine.

BRIEF DESCRIPTION OF THE DRAWING

The above and other objects and advantages of the present invention will become apparent from the following description when read in conjunction with the drawings wherein.

DETAILED DESCRIPTION OF A PREFERRED EMBODIMENT

Figure 1:
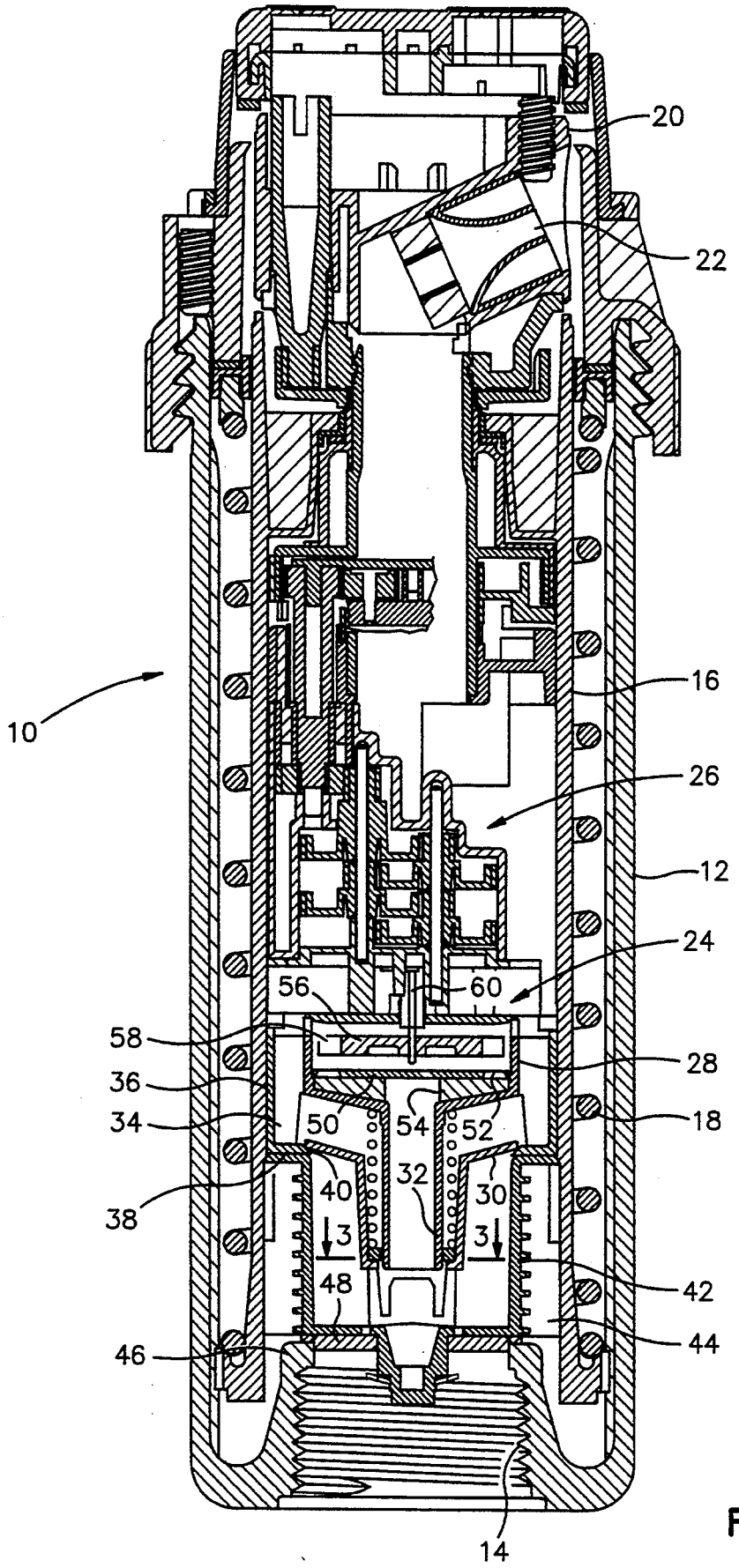
FIG. 1 is an elevation view in section of a typical sprinkler unit showing a preferred embodiment of the invention.
Figure 2:
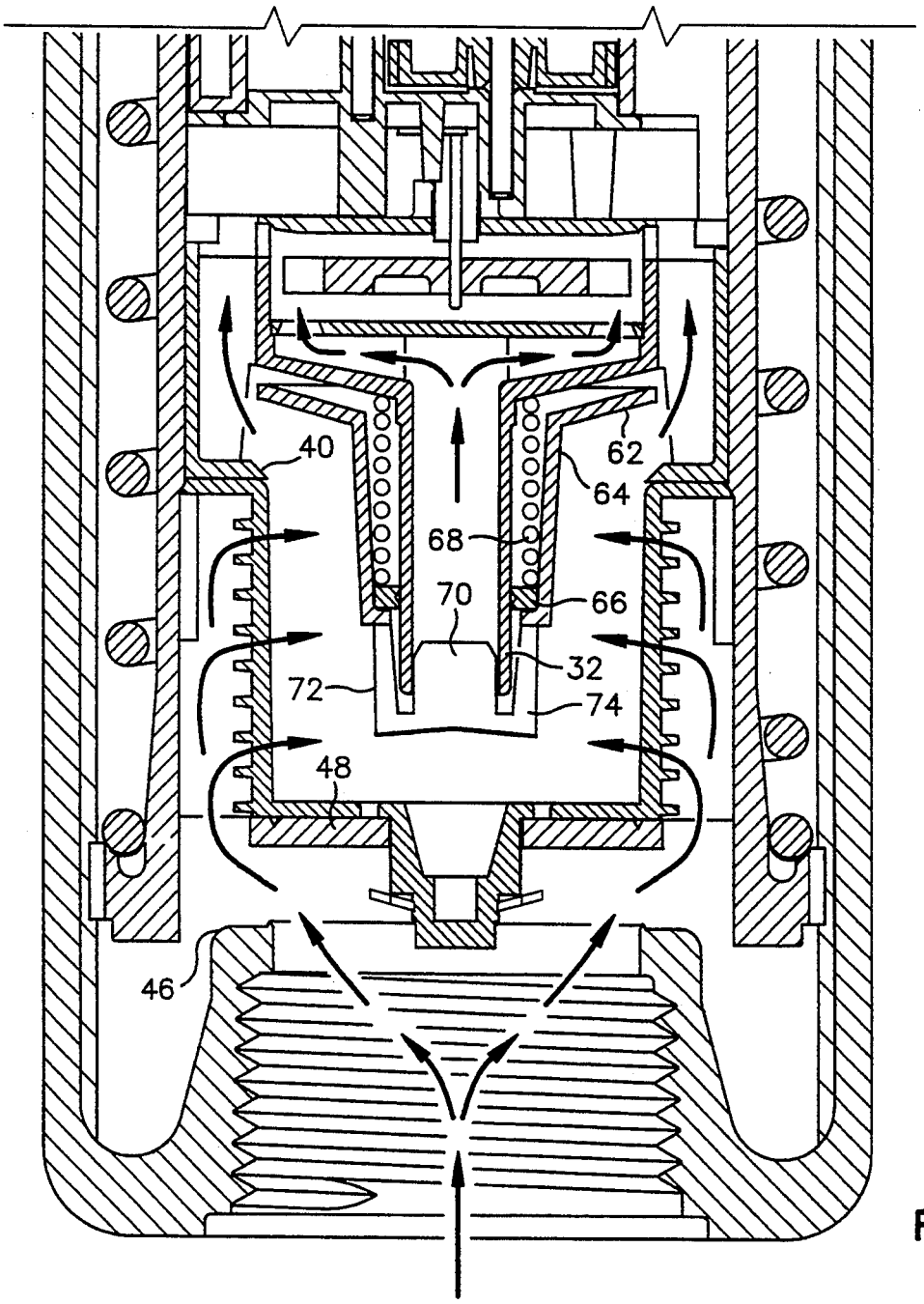
FIG. 2 is a partial view like FIG. 1 showing the throttle and by-pass valve in a second position of operation.

Referring now to the drawings, particularly FIG. 1, there is illustrated a sprinkler unit of the rotary type embodying a preferred embodiment of the present invention. The invention comprises a pop-up sprinkler unit, designated generally by the numeral 10, which comprises an outer generally tubular housing 12 having an inlet end, with an inlet 14 threaded for attachment to a source of water, such as a riser. An inner tubular housing 16 is telescopically received within the housing 12 and biased by a spring 18 to its retracted position substantially within the outer housing. The outlet end of the housing, which in this instance is the upper end, includes a rotary distributor head 20 having a nozzle 22 for distributing water around the axis of the sprinkler unit. The distributor head 20 is driven or rotated about its axis by means of a turbine assembly, designated generally at 24, which drives the head through a gear train, designated generally at 26. The gear train may drive the distributor head continuously in one direction, or drive it back and forth through an adjustable arc. The gear train and the distributor head will not be described in detail as these details do not form essential aspects of the present invention. These may be constructed in various manners, such as disclosed in prior U.S. patents of assignee, such as U.S. Pat. No. 4,568,024, issued Feb. 4, 1986 to Edwin J. Hunter; U.S. Pat. No. 4,796,809, issued Jan. 10, 1985 to Edwin J. Hunter; and U.S. Pat. No. 4,867,379, issued Sep. 19, 1989 to Edwin J. Hunter.

The present invention comprises an improved turbine assembly designed to provide a substantially constant rate of rotation over two different speed ranges for variations in water flow. The typical water supply for household use may vary between about thirty and seventy psi. Irrigation water supplies may also vary accordingly.

The turbine assembly comprises a stator housing having a substantially funnel shape with an upper portion 28 with an inwardly extending conical section 30 joined to an elongated tubular section 32. This stator assembly includes a plurality of radially extending spacers 34 which engage and rest within a sleeve 36 having inwardly directed lower rim 38 forming a valve seat at 40 at the inner edge thereof. This valve seat assembly rests against the upper end of a filter assembly 42 or strainer assembly that includes a generally cylindrical main body portion having screen passages therein and having radially extending ribs 44 that engage the inner surface of the tubular inner housing 16.

The lower end of the screen assembly rests against an inner annular shoulder 46 of the inlet coupling, with a seal member 48 disposed therebetween. The stator assembly includes an orifice plate 50 disposed within the pan portion thereof and having a plurality of orifices 52 therein. A plurality of partitions or ribs 54 are secured to the under surface of the orifice plate 50 and disposed between the plurality of orifices spaced circumferentially around the orifice plate.

A turbine wheel 56 having angled vanes 58 around its outer periphery is mounted on a rotatable shaft 60 that is connected to gearing through the gear train to drive the distributor head. The gear train may include a reversing mechanism to drive the distributor head in alternate directions through an arc that may be adjustable.

Water for driving the turbine is controlled by combination by-pass valve and throttling assembly. This assembly comprises a generally funnel shaped valve member having a substantially conical shape disc portion 62 and a tapered tubular portion 64 that surrounds tubular portion 32 of the stator assembly. The valve member includes a seal member 66 and a spring 68 which biases the valve to the closed position so that outer edges of the disc 62 are seated in sealing engagement with the valve seat 40.

Figure 3:
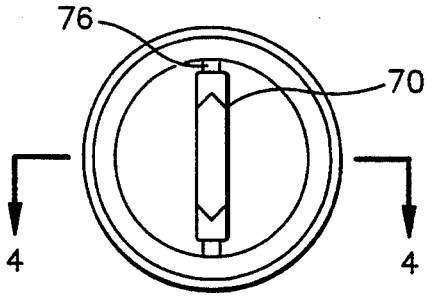
FIG. 3 is a section view taken on line 3—3 of FIG. 1.
Figure 4:
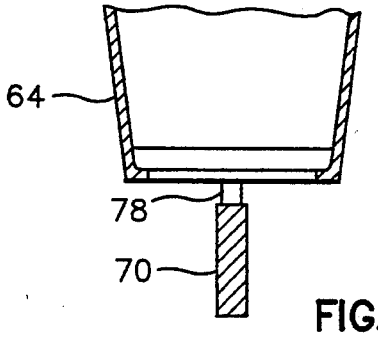
FIG. 4 is a section view taken on line 4—4 of FIG. 3.

A throttling assembly comprises a blade or tab 70 which is supported by a bridge like structure, including a pair of spaced apart arms 72 and 74 on the end of the valve portion 64. The blade 70, as best seen in FIG. 3, has a somewhat flat generally rectangular configuration but with sharp opposed edges 76 and 78. However, it may have any other suitable configuration such as square, round, tapered and/or combinations thereof. The throttling blade 76 is designed to extend into the end of the turbine flow passage formed by the tubular member 32 to progressively restrict the flow of fluid to the turbine wheel. The throttling blade moves with the valve 62, 64 as it is opening to permit the passage of a greater amount of water around the turbine assembly. Thus, the throttling blade and valve operate simultaneously to control the flow of water to the turbine and control its speed. The throttling blade is removable by breaking arms 72 and 74 to thereby remove its effect on the turbine and provide a second range of speed.

In operation, a sprinkler unit is mounted on a riser, and as water is introduced into the valve assembly, the inner housing 16 begins to rise from the bottom end of the outer housing 12, raising seal member 48 off of seat 46, permitting water to flow around the outside and into the interior of the screen 42. As the water pressure and flow rate increase, the valve 62 opens further, permitting a quantity of the water to flow along the side thereof and around the side of the turbine stator assembly. A quantity of water flows up through the center of the tubular portion of the stator assembly, and is directed by the turbine nozzles against the veins of the turbine wheel driving the turbine wheel. As water pressure and volume increases, the valve 62 opens further and the throttling blade 70 extends further into the tubular passageway formed by the tube 42, further restricting flow of water into the turbine and allowing a greater amount of water to flow around and by-pass the turbine.

A second stage or speed rate of the turbine is achieved by removal of the throttling assembly by breaking off fingers 72 and 74, thus breaking off and removing tab 70 from the end of the barrel of valve 62. Thus, the action with throttling blade 70 removed is that of diverting the water around the turbine stator assembly without any means for restricting the flow therethrough. This allows more water through the turbine and provides a second or higher speed range of operation of the turbine drive assembly.

With this arrangement, the rotation or oscillation of the distributor head can be increased in proportion to the flow of water through the nozzle. Thus, with appropriate modifications in the parameters, the sprinkler unit may be able to deposit two different ranges of water in a given unit of time.

While we have illustrated and described our invention by means of specific embodiments, it should be understood that numerous changes and modifications may be made therein without departing from the spirit and scope of the invention as defined in the appended claims.

I claim:

1. A sprinkler unit for distributing water from a source over an area of terrain comprising:

a tubular housing having an inlet connected by a passage to an outlet;

a distributor head mounted on said housing at said outlet for rotation about an axis for distribution of water via a nozzle;

a turbine wheel disposed in said housing passage and operatively connected for driving said distributor head; and a turbine stator assembly having first means including throttling means for controllably directing a first portion of water to said turbine wheel, and second means including pressure responsive valve means for controllably diverting a second portion of the water around said turbine wheel in proportion to the pressure thereof wherein said throttling means is moveable with said valve means for restricting the flow of water to the turbine wheel for maintaining the speed of said turbine wheel substantially constant.

2. A sprinkler unit according to claim 1 wherein said throttling means comprises a detachable throttling tab for providing a first range of speed for said turbine wheel when in position and a second range of speed when removed.

3. A sprinkler unit according to claim 2 wherein said tab extends into said first passage means during throttling of said turbine in said first range of speed.

4. A sprinkler unit according to claim 3 wherein said stator assembly comprises a tubular central section and a generally pan shaped end section defining a generally funnel shaped structure.

5. A sprinkler unit according to claim 4 wherein said turbine wheel is rotatably mounted in said generally pan shaped section.

6. A sprinkler unit according to claim 4 wherein said valve means has a generally funnel configuration surrounding said tubular central section.

7. A sprinkler unit for distributing water from a source over an area of terrain comprising;

a tubular housing having an inlet connected by a passage to an outlet;

a distributor head mounted on said housing at said outlet for rotation about an axis for distribution of water via a nozzle;

a turbine wheel disposed in said housing passage and operatively connected for driving said distributor head; and a turbine stator assembly having first means including throttling means for controllably directing a first portion of water through a first passage means to said turbine wheel, and second means including pressure responsive valve means for controllably diverting a second portion of the water around said turbine wheel in proportion to the pressure thereof wherein said throttling means comprises a tab carried by said valve means and extendable into said first passage means as said valve means opens for maintaining the speed of said turbine wheel substantially constant.

8. A sprinkler unit according to claim 7 wherein said second means includes second passage means that is annular.

9. A sprinkler unit having nozzle means for distribution of a given quantity of water therefrom, comprising:

a housing having an inlet and an outlet and passage means for connecting said inlet to said outlet, said housing further including means for connecting said inlet to a source of water;

a distributor head rotatably mounted to said outlet and including said nozzle means for distributing a stream of water outward from said housing;

a turbine wheel disposed in said passage means and operatively connected for driving said distributor head; and turbine stator means including pressure responsive valve means and throttling means in said passage means for controllably diverting a portion of the water around said turbine wheel in proportion to the pressure thereof, wherein said throttling means is movable with said valve means for restricting the flow of water to the turbine wheel for maintaining the speed of the turbine wheel substantially constant.

10. A sprinkler unit according to claim 9 wherein said throttling means comprises a tab carried by said valve means as it opens.

11. A sprinkler unit according to claim 10 wherein said stator means comprises a tubular central section and a generally pan shaped end section defining a generally funnel shaped structure.

12. A sprinkler unit according to claim 11 wherein said turbine wheel is rotatably mounted in said generally pan shaped end section.

13. A sprinkler unit according to claim 12 wherein said valve means has a generally funnel configuration surrounding said tubular central section.

14. A sprinkler unit according to claim 9 wherein said throttling means comprises a removable tab carried by and moveable with said valve means for restricting the flow of water to the turbine wheel when carried thereby.

15. A sprinkler unit having throttled turbine means for maintaining a substantially constant speed of rotation of a distributor head, comprising:

a generally tubular housing having an inlet, an outlet and a central passage connecting said inlet to said outlet;

a distributor head including a nozzle mounted at said outlet for distributing a stream of water outward from said housing; and said turbine means including a turbine wheel and a stator assembly disposed in said central passage and operatively connected for driving said distributor head, said stator assembly having first passage means including throttling means for controllably directing a first portion of water to said turbine wheel, and second passage means including pressure responsive valve means for controllably diverting a second portion of the water around said turbine wheel in proportion to the pressure thereof for maintaining the speed of the turbine wheel substantially constant wherein said stator assembly comprises a tubular central section and a generally pan shaped section defining a generally funnel shaped structure, said pan shaped section defining a chamber within which said turbine wheel is mounted.

16. A sprinkler unit according to claim 15 wherein said throttling means comprises a tab carried by said valve means and extendable into said first passage means as said valve means opens.

17. An interrupted stream rotary sprinkler unit according to claim 15 wherein said valve means has a generally funnel configuration surrounding said tubular central section.

* * * * *